US008225579B2

(12) United States Patent
Fimbel, III et al.

(10) Patent No.: US 8,225,579 B2
(45) Date of Patent: Jul. 24, 2012

(54) CARVED SOLID FACE DOORS HAVING INLAID OVERLAYS AND METHODS OF FABRICATION

(76) Inventors: Edward Fimbel, III, Lambertville, NJ (US); Jeffry T. Deal, Lambertville, NJ (US)

( * ) Notice: Subject to any disclaimer, the term of this patent is extended or adjusted under 35 U.S.C. 154(b) by 165 days.

(21) Appl. No.: 12/427,518

(22) Filed: Apr. 21, 2009

(65) Prior Publication Data

US 2009/0260308 A1 Oct. 22, 2009

Related U.S. Application Data

(60) Provisional application No. 61/046,778, filed on Apr. 21, 2008.

(51) Int. Cl.
*E04C 2/54* (2006.01)

(52) U.S. Cl. ..... 52/784.1; 52/314; 52/316; 52/455; 52/457; 52/783.1

(58) Field of Classification Search ..... 52/314, 52/316, 455, 457, 783.1, 784.1, 796.1
See application file for complete search history.

(56) References Cited

U.S. PATENT DOCUMENTS 3,269,339 A * 8/1966 Lingal ..... 109/74
3,498,001 A * 3/1970 MacDonald ..... 49/501
3,731,443 A * 5/1973 Zaroor ..... 52/309.7
3,760,543 A * 9/1973 McAllister ..... 52/204.591
3,903,669 A * 9/1975 Pease et al. ..... 52/455
4,265,068 A * 5/1981 Pomroy ..... 52/456
4,441,296 A * 4/1984 Grabendike et al. ..... 52/456
4,579,613 A * 4/1986 Belanger ..... 156/78
4,592,402 A * 6/1986 Spofford ..... 144/346
4,702,054 A * 10/1987 Turner ..... 52/455
4,704,834 A * 11/1987 Turner ..... 52/311.2
4,706,431 A * 11/1987 Corvese ..... 52/313
4,716,705 A * 1/1988 Formanek et al. ..... 52/784.1
4,812,188 A * 3/1989 Hansen ..... 156/220
4,853,062 A * 8/1989 Gartland ..... 156/219
4,882,877 A 11/1989 Guetle, Jr. et al.
D304,983 S * 12/1989 Palka ..... D6/492
5,022,206 A * 6/1991 Schield et al. ..... 52/455
5,062,915 A * 11/1991 Yoon et al. ..... 156/252
5,095,675 A * 3/1992 Audia ..... 52/455
5,175,970 A * 1/1993 Green ..... 52/309.9
5,285,608 A * 2/1994 Costello ..... 52/456
5,438,808 A 8/1995 Costello (Continued)

OTHER PUBLICATIONS

Office Action from the United States Patent and Trademark Office dated Dec. 24, 2009 for U.S. Appl. No. 11/538,870.

(Continued)

*Primary Examiner* — Brian Glessner
*Assistant Examiner* — Joshua Ihezie
(74) *Attorney, Agent, or Firm* — Alan Taboada; Moser IP Law Group

(57) ABSTRACT

Carved solid face doors having inlaid overlays and methods of manufacture thereof are provided herein. In some embodiments, a carved, solid face door may include a solid base having a face and an opposing rear surface, wherein the face has a design carved into at least one section of the face; one or more channels carved into the face adjacent to the design, each channel having a depth that is below a depth of the design carved into face of the door adjacent to the channel; and one or more inlay panels disposed in the one or more channels.

16 Claims, 6 Drawing Sheets

U.S. PATENT DOCUMENTS 5,469,903 A * 11/1995 Stanley ..... 144/345
5,487,245 A * 1/1996 Dazo et al. ..... 52/204.61
5,540,026 A * 7/1996 Gartland ..... 52/455
5,560,168 A * 10/1996 Gagne et al. ..... 52/455
5,568,713 A * 10/1996 Gagne et al. ..... 52/785.1
D380,279 S 6/1997 Lint et al.
5,766,774 A * 6/1998 Lynch et al. ..... 428/537.1
5,775,041 A * 7/1998 Tull et al. ..... 52/455
5,782,055 A * 7/1998 Crittenden ..... 52/784.1
5,829,218 A * 11/1998 Murray et al. ..... 52/455
5,884,444 A 3/1999 Harris
5,887,402 A 3/1999 Ruggie et al.
5,918,434 A * 7/1999 Ballantyne et al. ..... 52/311.1
6,148,896 A 11/2000 Pinto et al.
6,185,894 B1 * 2/2001 Sisco et al. ..... 52/457
6,190,782 B1 * 2/2001 French ..... 428/542.2
6,335,082 B1 1/2002 Martino
6,513,558 B1 * 2/2003 Chen ..... 144/345
6,584,667 B1 * 7/2003 Frumkin ..... 29/458
6,619,010 B2 * 9/2003 Wang Chen ..... 52/784.13
6,688,063 B1 * 2/2004 Lee et al. ..... 52/455
D501,931 S * 2/2005 Davina et al. ..... D25/48
6,952,903 B2 * 10/2005 West et al. ..... 52/455
7,007,435 B2 * 3/2006 Ballantyne ..... 52/455
7,137,232 B2 * 11/2006 Lynch et al. ..... 52/784.1
7,178,308 B2 * 2/2007 Fagan et al. ..... 52/800.1
7,185,468 B2 * 3/2007 Clark et al. ..... 52/455
D541,947 S * 5/2007 Schafernak et al. ..... D25/48
D543,641 S * 5/2007 Walsh et al. ..... D25/48
7,210,274 B2 * 5/2007 Ballantyne et al. ..... 52/366
D553,756 S * 10/2007 Davina et al. ..... D25/48
D554,769 S * 11/2007 Hardaway ..... D25/48
D555,806 S 11/2007 Berryman
7,328,539 B2 2/2008 Hunt et al.
7,481,900 B1 * 1/2009 Quinif ..... 156/221
D615,212 S * 5/2010 Walsh et al. ..... D25/48
2003/0014932 A1 1/2003 Wang et al.
2004/0172914 A1 * 9/2004 Lancia ..... 52/784.1
2007/0024085 A1 * 2/2007 Steelman ..... 296/153
2007/0193220 A1 * 8/2007 Daniels ..... 52/784.11
2008/0256885 A1 * 10/2008 Walsh et al. ..... 52/316

OTHER PUBLICATIONS

"Cutting-edge technology makes woodworking profitable," Wood & Wood Products, Mar. 2009.
Office Action from the United States Patent and Trademark Office dated Jun. 28, 2010 for U.S. Appl. No. 11/538,870.
Office Action from the United States Patent and Trademark Office dated Nov. 3, 2010 for U.S. Appl. No. 11/538,870.
Final Office Action from the United States Patent and Trademark Office dated May 24, 2011 for U.S. Appl. No. 11/538,870.

* cited by examiner

FIG. 3
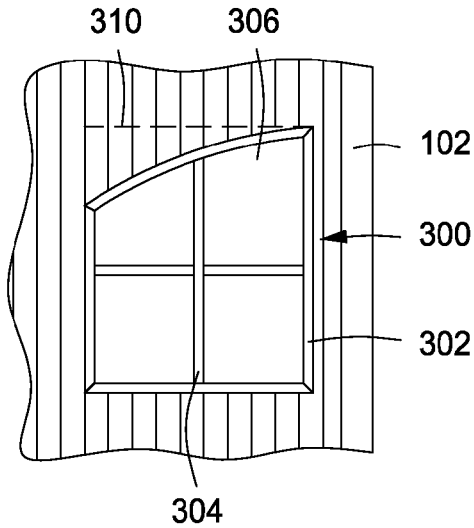
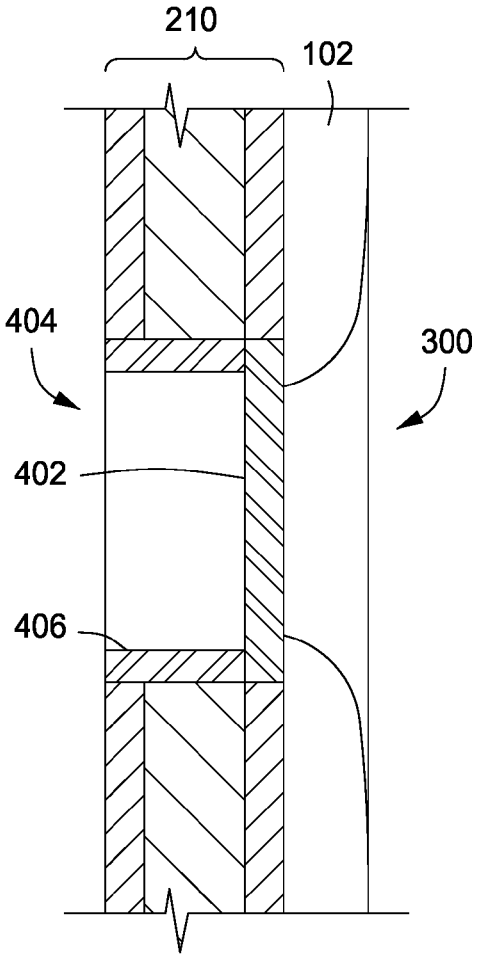
FIG. 4A
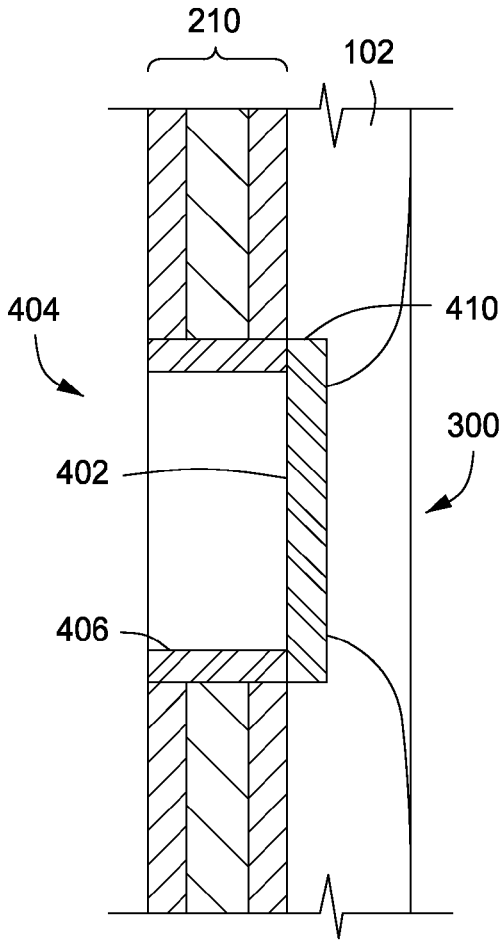
FIG. 4B

CARVED SOLID FACE DOORS HAVING INLAID OVERLAYS AND METHODS OF FABRICATION

CROSS-REFERENCE TO RELATED APPLICATIONS

This application claims benefit of U.S. provisional application Ser. No. 61/046,778, filed Apr. 21, 2008. This application is further related to U.S. patent application Ser. No. 11/538,870, filed Oct. 5, 2006, which claims benefit of U.S. Provisional Patent Application Ser. No. 60/723,764, filed Oct. 5, 2005. Each of the aforementioned applications are herein incorporated by reference in their entireties.

BACKGROUND

1. Field

The present invention generally relates to doors and, more particularly, to doors having a façade formed from a solid piece of material and methods of manufacturing thereof.

2. Description of the Related Art

Doors, and particularly large doors such as overhead garage doors, come in numerous styles, shapes, and sizes. In a residential setting, many people prefer garage doors that are embellished or stylized to enhance the outer appearance of their homes. Such garage doors may be manufactured using a stamped metal or vinyl exterior or a more traditional multiple-piece construction (such as rail and stile construction).

However, these manufacturing methods each have their own drawbacks. For example, garage doors having a stamped metal exterior have design limitations due to the nature of the materials and tools required to form the desired patterns on the face of the door. In addition, each design requires varying tools to stamp the designs into the door. As such, this method is very expensive to use for larger numbers of designs.

Multiple-piece construction techniques are usually very time-consuming, due to the number of different parts that must be fabricated, aligned, and assembled to form the door. Moreover, the likelihood of quality control issues arising, such as out of tolerance, overall appearance of the door, or door-to-door variations increases with the number of components to be fabricated and pieced together. Numerous other problems exist in the art with respect to the fabrication and assembly of doors, as discussed herein.

Therefore, a need exists for a door suitable for ease of fabrication and flexibility of design options.

SUMMARY

Carved solid face doors having inlaid overlays and methods of manufacture thereof are provided herein. In some embodiments, a carved, solid face door may include a solid base having a face and an opposing rear surface, wherein the face has a design carved into at least one section of the face; one or more channels carved into the face adjacent to the design, each channel having a depth that is below a depth of the design carved into face of the door adjacent to the channel; and one or more inlay panels disposed in the one or more channels.

In some embodiments, a method for fabricating a door may include providing a solid base having a face and an opposing rear surface; carving a design into the face; carving one or more channels into the face adjacent to the design and to a depth that is below the design carved into the face; and attaching one or more inlay panels to the face within the one or more channels.

BRIEF DESCRIPTION OF THE DRAWINGS

So the manner in which the above recited features of the present invention can be understood in detail, a more particular description of the invention, briefly summarized above, may be had by reference to the embodiments thereof, some of which are illustrated in the appended drawings. It is to be noted, however, the appended drawings illustrate only typical embodiments of this invention and are therefore not to be considered limiting of its scope, for the invention may admit to other equally effective embodiments.

FIG. 3 is depicts a window that may be formed in the door of FIG. 1.

FIGS. 4A-B depict a partial sectional side view of embodiments of the window of FIG. 3.

To facilitate understanding, identical reference numerals have been used, where possible, to designate identical elements that are common to the figures.

DETAILED DESCRIPTION

Embodiments of the present invention provide a door suitable for ease of construction in a variety of styles/designs and a method of manufacturing the door. The door may be any door, including front entranceways, overhead garage doors, side-mounted garage doors, and the like. The door has a solid flat face with a desired design carved into the flat face. The design may emulate the look of a door manufactured using other traditional techniques, such as stamping or multiple-piece construction (e.g., rail and stiles, raised panels, and the like). Optionally, the door may have a backing affixed to the front face for support. The door may be efficiently manufactured using computer-aided machinery to carve the design.

Figure 1:
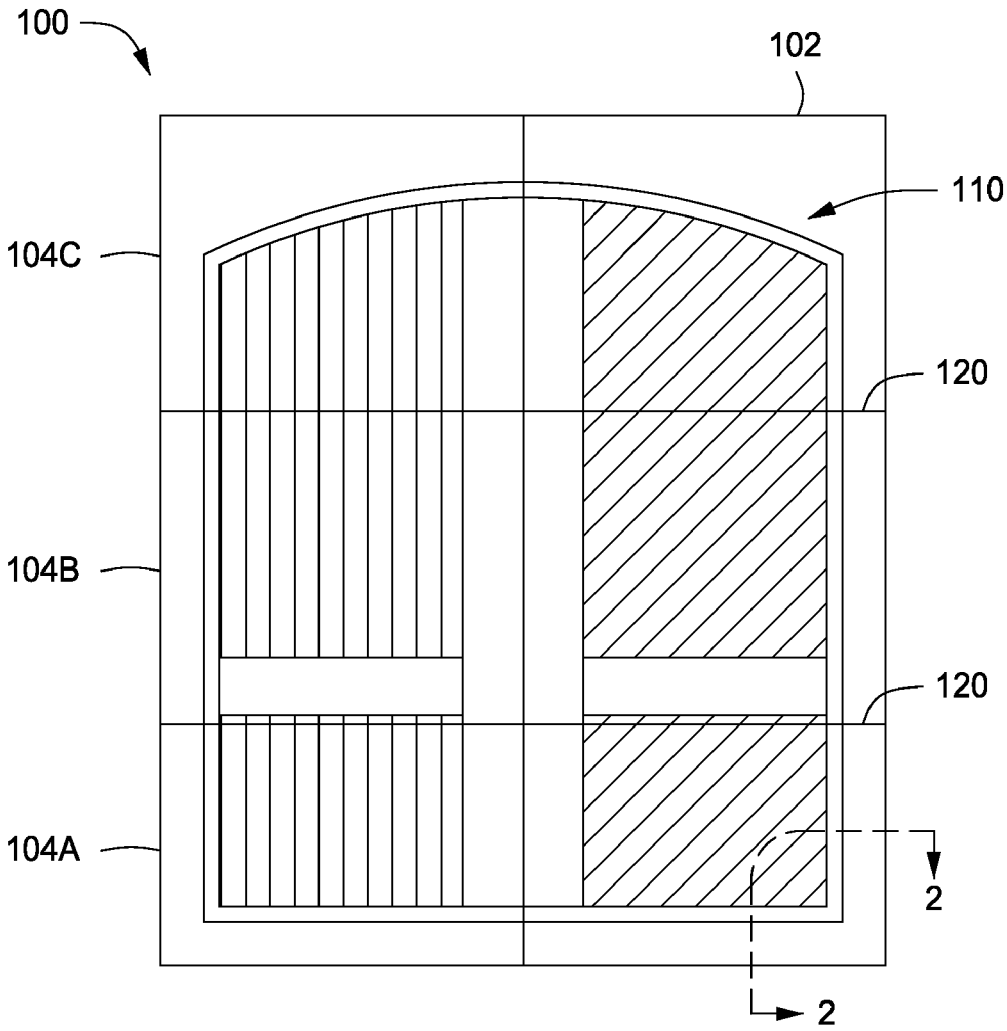
FIG. 1 depicts a front view of one embodiment of a door of the present invention.

FIG. 1 depicts one embodiment of a door 100 of the present invention. The door 100 generally comprises a solid base having a flat face 102 into which a design 110 is carved. The flat face 102 may comprise any suitable workable material, such as wood, medium density fiberboard (MDF), plastic, cellular polyvinyl chloride (PVC), and the like. Alternatively, the flat face 102 may comprise a flat laminate of multiple sheets of one or more of the aforementioned materials.

The flat face 102 of the door 100 may optionally further comprise multiple sections. In the embodiment depicted in FIG. 1, three sections 104A-C are depicted. The sections 104A-C may be formed by cutting the door 100 along lines 120 after forming the design 110 or, the sections 104A-C may be individually fabricated and thereafter assembled to form the final door 100. It is contemplated that the door 100 may comprise any number of sections, including a single section.

The design 110 is carved into a front portion of the flat face 102 to form a generally decorative pattern in the door 100. The design 110 may be carved into the flat face 102 in a variety of ways. In one embodiment, the design 110 is carved into the flat face 102 using a computer-controlled machine, such as a computer numerical control (CNC) milling machine, or the like. Using a computer-aided machine, the design 110 may be formed into the flat face 102 of the door 100 with tight tolerances, repeatability, speed, and excellent process control. Moreover, the design 110 may be expediently and inexpensively changed or altered to varying designs simply by loading a new design into the computer-aided machine. This facilitates greater speed and flexibility of manufacturing as compared to expensive and time consuming traditional methods of manufacturing doors.

By carving the design 110 into the flat face 102 of the door 100, embodiments of the present invention facilitate emulation of the look of a traditional multi-piece construction (such as at least one of a frame, a rail, a stile, a molding, a trim, a plurality of planks, or a panel) with greater design flexibility, process repeatability, and speed of construction. In addition, carving the design 110 into the flat face 102 of the door facilitates greater design flexibility as compared to traditional stamped steel and vinyl construction techniques. Specifically, the carved design 110 may have designs that flow between adjacent sections (e.g., sections 104A-C) of the door 100. In stamped steel doors, the sections typically have uniform raised edges due to the rolled edge at the border of adjacent sections. Moreover, in accordance with embodiments of the present invention, changing from one design to the next in a production environment may be accomplished by merely loading, or selecting a preloaded, new design program in the computer-controlled machine, thereby facilitating simple, quick, and practically seamless changeovers to new products.

Figure 2:
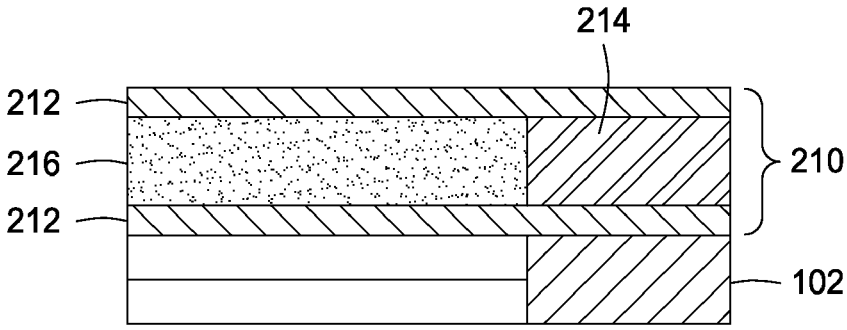
FIG. 2 is a partial sectional view of the door of FIG. 1, taken along section lines 2-2.

In one embodiment, the door 100 may further optionally comprise a backing to stiffen, strengthen, or otherwise structurally support the flat face 102. FIG. 2 depicts one embodiment of a backing 210 affixed to a rear surface of the flat face 102. The backing 210 may be affixed to the flat face 102 in any suitable manner, such as by gluing, bonding, epoxying, screwing, bolting, otherwise adhering or affixing, and the like.

The backing 210 may comprise one or more elements arranged to support the flat face 102 as described above. In one embodiment, the backing 210 comprises an outer frame 214 and an optional inner core 216 that are covered with a skin 212. The frame 214 may comprise wood, plastic, metal, or any other suitable material or combination of materials. The inner core 216 may comprise foam or other suitable material and may provide a high insulative rating, or R-value. The skins 212 may comprise any thin, structurally sound material, such as plywood, wood, plastic, MDF, hardboard, and the like. It is contemplated that the flat face 102 may comprise structural elements such as metal rods and or bars in place of or in addition to the backing 210. In an alternative embodiment, the outer frame 214 may be directly affixed to the flat face 102. In this arrangement, relatively larger openings and/or glass sections, and the like, can be formed in the door 100.

Most people who buy doors, particularly carriage style garage doors, want glass options. One option can be achieved by affixing a grille made of plastic, metal or wood to the exterior of a window. Sometimes the grille is enclosed between two pieces of glass when insulated glass windows are used. These grilles are generally an inexpensive approach to creating a design, however there are several drawbacks: (1) To be inexpensive, most grilles are stamped or molded. However, when stamping or molding, the number of designs and sizes are limited, as the tooling costs for stamping and molding is very expensive. (2). Grilles look good from a distance, but close up look far less appealing. (3). Grilles compromise the appearance of the door because they are generally inserted into the face of a door leaving a perimeter outline.

Another method is to emboss or paint a design onto a piece of glass or clear acrylic. This can be an inexpensive approach. However, like grilles, this looks good from a distance but is not appealing from a close perspective. Finally, there is the traditional architectural approach called true-divided lights or T.D.L. For centuries, glass designs have been created by putting together stiles and mullions then each hole in the design is glazed with individual pieces of glass. The end product is a beautiful creation that looks as good close up as it does from a distance. This method can be used to create an infinite number of designs and sizes but it has its limitations: (1). True-divided lights are extremely costly and very labor intensive to manufacture. The more intricate the design, the higher the cost. (2). True-divided lights, because they are very time consuming to fabricate, can increase lead times getting product to the customer. (3) Because they are formed from stiles and mullions, true-divided lights have joints where each stile and mullion attach. On exterior applications these joints can open up over time and work loose. True-divided windows usually require more maintenance to keep them looking good and functioning well.

Accordingly, utilizing methods as disclosed herein, CNC (Computer Numerical Control) equipment, or the like, may be utilized to carve window patterns out of a base sheet material (e.g., the solid face of the door). The benefits: (1). The carved face can look exactly as rich and detailed as real true-divided lights from an architectural standpoint. The carved pattern looks as good close up as it does from a distance unlike a grille. (2). Using CNC technology, an infinite number of designs and sizes can be created. These can be created quickly, accurately and at a much lower cost than the traditional true-divided light technology. (3). The carved technology leaves no perimeter outline on the face of door sections like grilles do. (4). Unlike true-divided frames, there are no joints where the stiles and rails meet to work loose over time. The machined tops of the sheet material require very little maintenance.

For example, as disclosed in U.S. patent application Ser. No. 11/538,870, filed Oct. 5, 2006 and U.S. Provisional Patent Application Ser. No. 60/723,764, filed Oct. 5, 2005, FIG. 3 depicts one embodiment of an optional window 300 that may be formed in the door 100 depicted in FIG. 1. The window 300 is formed in the flat face 102 of the door 100 in similar fashion as the design 110. Specifically, the window 300 is carved into the flat face 102 of the door in a desired location. Structural and/or design elements, such as the frame 302 and mullions 304, may optionally be carved into the flat face 102 of the door 100, leaving openings 306 that pass completely through the flat face 102 of the door 100. In embodiments where a backing is used (as depicted in FIG. 2), a corresponding opening is formed in the backing.

The use of a computer-aided machine greatly reduces the time and effort required to align any openings formed in the backing and in the flat face 102. As can be seen in the window 300 of FIG. 3, the openings 306, and optional frame 302 and/or mullions 304 do not need to be square. As the openings 306 are carved out of a solid piece of material (e.g., the flat face 102), the openings 306 may take practically any shape or design, such as circles, ellipses, waves, amoebic forms, as well as triangles, squares, rectangles, other polygons, or combinations thereof.

The window 300 may be left open, or a piece of material such as glass, plastic, or the like (typically glass) may be provided to cover the openings 306 of the window 300. To facilitate manufacture, the glass for the window 300 may be cut into a convenient polygonal shape, such as a square or rectangle, and may be secured to the backside of the flat face.

In embodiments where a backing is used, the backing may have a corresponding opening that facilitates the placement of the glass in the window 300, as indicated by the dashed lines 310 in FIG. 3.

In one embodiment, as depicted in FIG. 4A, a hole 404 is formed in the backing 210 corresponding to the location of the window 300 such that a piece of glass 402 or other desired material may be placed in the opening 404 and rest against the back surface of the flat face 102. An insert 406 may then be placed over the glass 402 to secure it in place and to provide a clean, finished appearance to the hole 404 in the backing 210.

In another embodiment, depicted in FIG. 4B, a rabbet 410 may be machined into the backside of the flat face 102 to accommodate the glass 402 such that it rests flush with the backside of the flat face 102. The insert 406 is then placed within the hole 404 to secure the glass 402 and provide a clean, finished appearance to the hole 404 in the backing 210.

Figure 5:
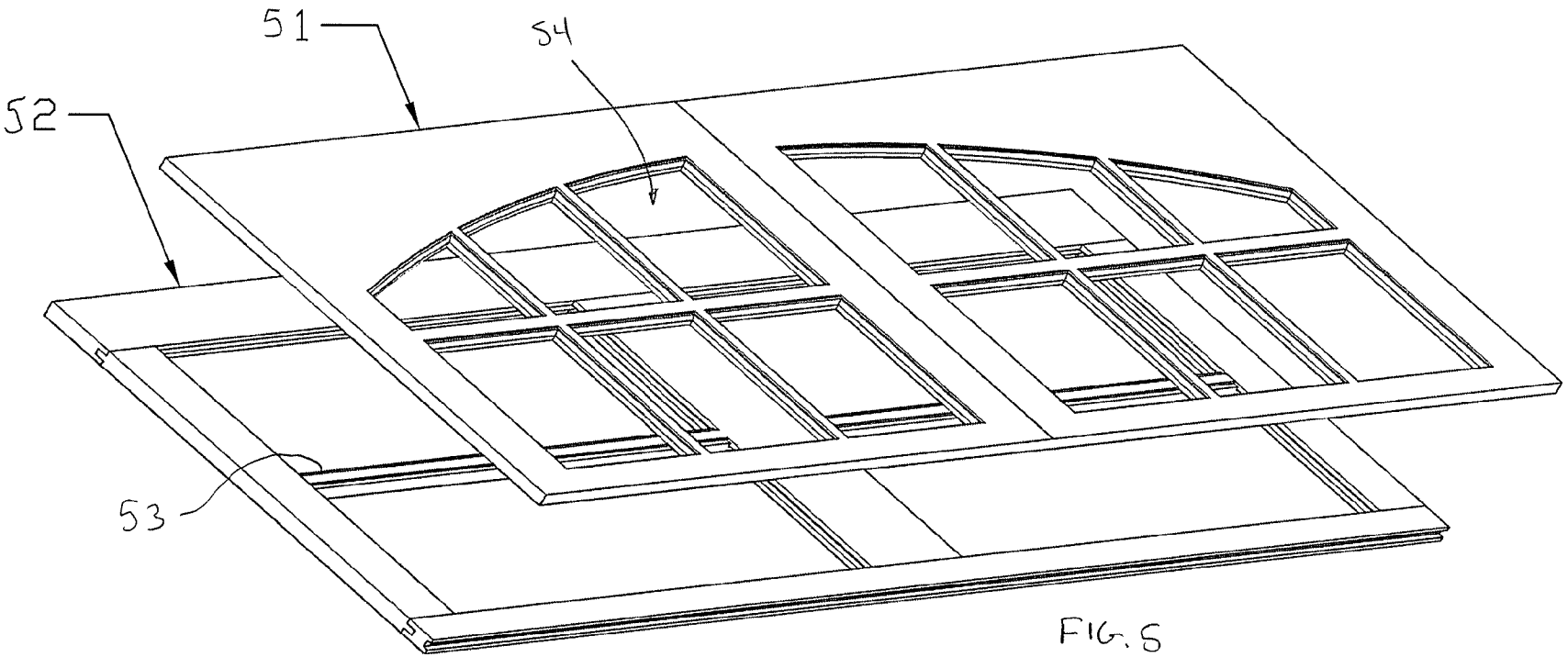
FIG. 5 depicts a window that may be formed in a door in accordance with some embodiments of the present invention.

In some embodiments, as depicted in FIG. 5, a window may be formed by machining a plurality of holes 54 (e.g., to emulate a traditional true-divided light or other window design) in a sheet face substrate 51 using, for example, the CNC machining techniques disclosed above. As in the example above, a corresponding opening 55 may be formed in a backing 52 to allow the holes 54 to extend through the door and, in some embodiments, to receive and/or to trap one or more panes of glass between the backing 52 and the face substrate 51.

In some embodiments, for example where the holes 54 cover a large area, one or more reinforcement bars 53 may be formed in or coupled to the backing 52 and attached to the face substrate 51. The reinforcement bars 53 may facilitate adding structural integrity to the face substrate 51 in the region where the holes 54 are formed (for example, to prevent flexing of the portion of the door where the window is formed, or the like) and may prevent any deformation or buckling of the thin dividing portions between the holes 54 (for example, due to expansion and/or contraction of the thin dividing portions, or the like). Multiple panes of glass may be utilized in such embodiments to facilitate securing the reinforcement bars 53 to the face substrate 51.

Machined Inlaid Overlays and Location System

Generally door designs and specifically carriage style garage doors are created by stamping or molding the design or adding overlays to form a design pattern. Stamping or molding is very efficient if the number of sizes are limited. Overlays on the other hand can be used to create an infinite number of patterns and are not limited to design or size. However, applying overlays in the conventional sense has three (3) big drawbacks: (1). It is a very time consuming process versus stamping or molding. (2). Many doors, including garage doors are made in sections. In order to form the design, the sections need to be manually laid out. The design is created with much measuring and then the overlays are glued or fastened down to the door sections. If more than one door of a given size is required with the same pattern, then the sections need to be individually identified after completion in complete door sets as each one is unique so that they will not be mixed up. Mixing sections with overlays applied in a conventional manner can cause alignment issues. Unlike stamping or molding a design or pattern, no two sections with hand applied overlays will match exactly, thus the reason for marking sections when more than one door of the same size and pattern is required with conventional manufacturing methods. (3). When a design is stamped, the face is free of any possibility of water or other elements invading thru the surface. On the other hand, overlays when applied to door skin using conventional methods leave areas for water or dirt to collect. On an exterior application, this is a potentially serious problem. If water or dirt gets behind the overlay, it can cause the overlay to deteriorate or fall off. It can also cause the door section in general to rot or rust at an accelerated rate.

However, using techniques as disclosed herein, for example, carving the face of the door using CNC equipment, an infinite number of designs and sizes of door designs and overlays can be manufactured quickly and accurately, regardless of the number of sections of the door. Whether carving a pattern, or machining overlays and a pattern, or machining overlays and locating the overlays so that they can be interchangeable, the CNC blends the best of both worlds. However, when making doors with overlays, no matter how accurately they are done, the potential is still there for the elements on exterior applications to destroy the door as cited under item (3) above. The inventive solution is to carve a channel into the face of the door to a depth that is lower than the decoration on the face of the door so that the overlay will be inset beyond any face detail that would otherwise permit water to get behind the overlay. The carved channel also acts as a locator so that the overlays are always positioned correctly.

Figure 6:
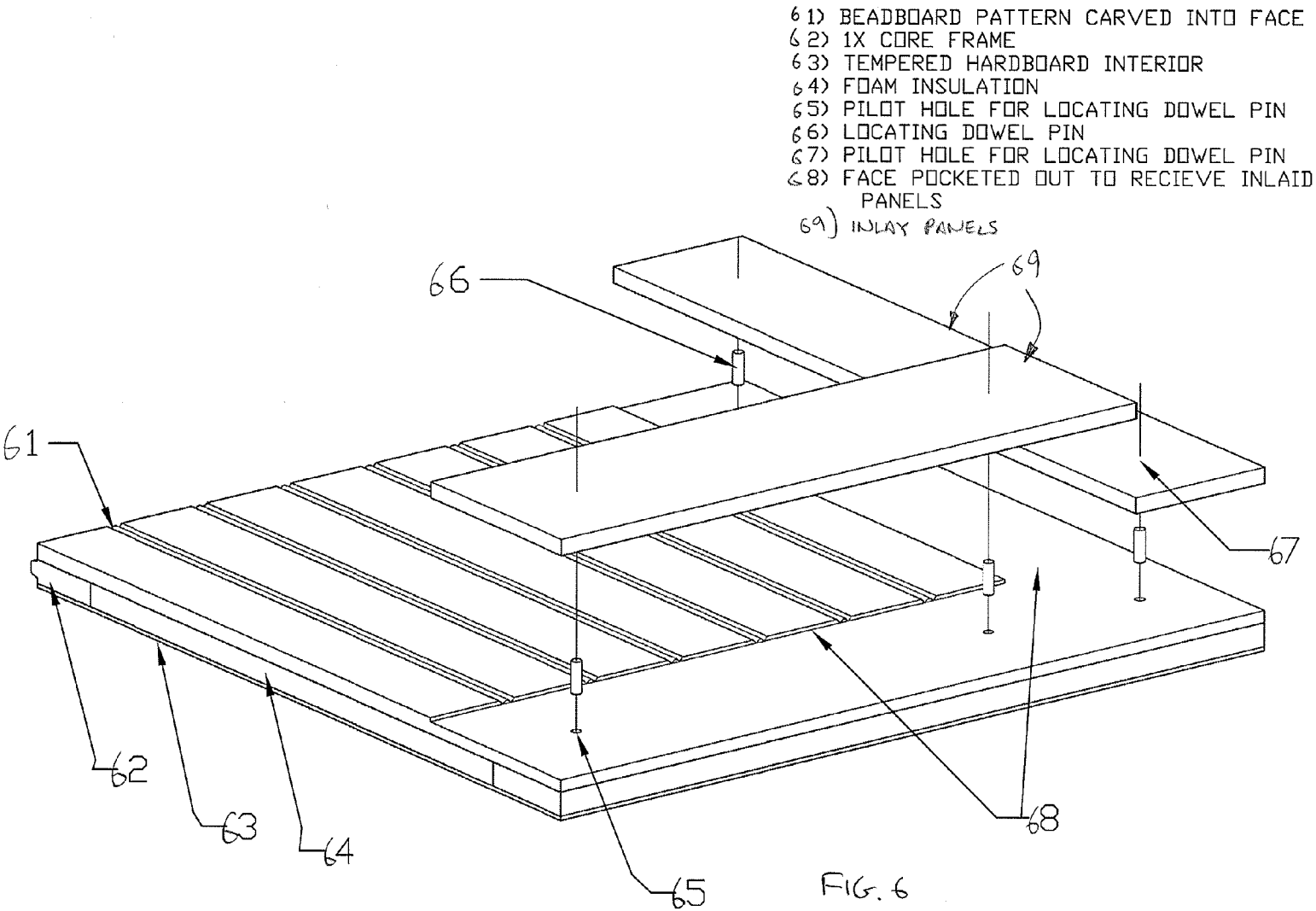
FIG. 6 depicts a partial view of a door in accordance with some embodiments of the present invention.

For example, FIG. 6 depicts a partial perspective view of a door having a beadboard pattern carved into a face 61 of the door. As discussed above, the face 61 may be attached to a backing having, for example, a core frame 62, a hardboard interior material 63, and foam insulation 64. The face 61 may be machined (e.g., pocketed out) to form channels 68 for receiving inlay panels 69. The channels 68 are formed in the face 61 of the door to a depth that is lower than the decoration on the face of the door (e.g., the beadboard pattern in the example of FIG. 6) so that the overlay (e.g., inlay panels 69) will be inset beyond any face detail that would otherwise permit water to get behind the overlay. The carved channels 68 may also act as a locator so that the inlay panels 69 are always positioned correctly.

Moreover, Traditional carriage house door manufacturing techniques rely upon manual measuring and clamping to affix overlays to the surface of a door. Since manual methods are utilized, each overlay in its own location is unique, even if duplicate doors with identical sizes and patterns are produced. This does not lend itself to mass production assembly methods as each part must be custom fit and affixed. This also exacerbates the alignment problem for multiple section doors, discussed in (2), above.

To address this deficiency, utilizing high precision technology such as CNC equipment, overlays can be accurately machined incorporating features for accurately locating them on door faces. Every overlay of a certain design will be identical to the next, as high precision methods are used to manufacture them. The locating means could be a blind hole accurately placed in the same spot on every overlay of the same design. The blind hole will match an identical hole accurately machined in the face of the door surface which will contain a locating means, in this case a pin, to locate and register the position of the overlay identical to every door section of similar design. This approach lends itself to mass production methods, as repeatable, identical parts are accurately registered in identical locations on identical door sections.

For example, in some embodiments, a plurality of locating pins 66 may be provided in respective holes formed in the channels 68 and in the backside of the inlay panels 69 (e.g., pilot holes 65 and 67). The locating pins 66 facilitate aligning and locating the inlay panels 69 such that replacement pieces and/or sections of a multiple section door may be installed and/or interchanged while retaining a high degree of alignment.

Figure 7:
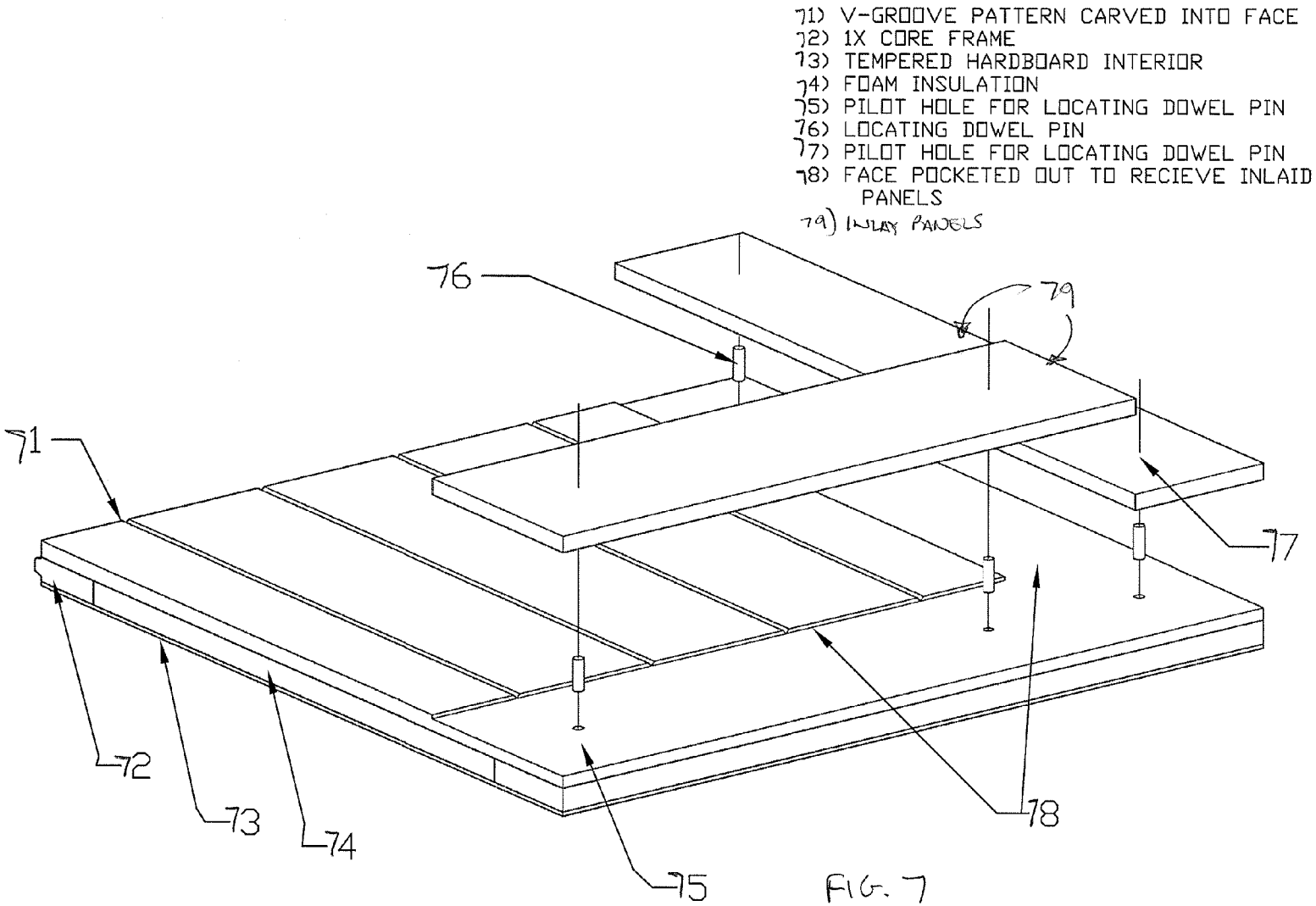
FIG. 7 depicts a partial view of a door in accordance with some embodiments of the present invention.

FIG. 6 depicts just one illustrative example of the above concepts and doors having other carved patterns, other inlay patterns, or the like may be fabricated utilizing the teachings disclosed herein. For example, FIG. 7 depicts a door having a v-groove pattern formed in the face 71, but otherwise similar to the embodiment depicted in FIG. 6.

Raised Panel Door Embodiment

Raised panel doors are a very popular architectural product and have been for centuries. Raised panel doors were historically made primarily from wood utilizing highly accepted and well established manufacturing methods. Wood raised panel doors have several drawbacks: (1). Wood raised panels are designed to float inside a frame to allow for thermal expansion and contraction, an essential element of design proven over centuries of use. Since the panel floats inside a frame, often the panel shrinks and exposes unfinished raw wood along its edges, accelerating the rotting and decay of the panels. (2). The floating panel necessitates a clearance between the panel and the frame in which it floats. This clearance allows water and moisture to gain access to unfinished areas of the door, again accelerating the rotting and decay of the entire door structure. (3). One of the most common modes of failure for a wood raised panel door is for the raised panel to crack, again causing a major cosmetic flaw and exposing untreated wood to the elements and premature failure. Some have attempted to address the common problems with a wood raised panel door by substituting metal or plastic for the wood. Metal raised panel doors are stamped, plastic doors are molded or thermo-formed, all requiring very expensive tooling and limiting the designs possible due to high tooling cost and raw material constraints.

As such, in some embodiments of the present invention, raised panels may be carved out of a stable sheet material using similar techniques and equipment as discussed above. Overlays maybe applied around the raised panel rather than inserting the panel into a frame, thus eliminating the concerns of traditional wood raised panel construction. This technique provides the following advantages: (1) Materials are available today in sheet form that resist or are impervious to forms of environmental attack. With a carved surface and applied overlays to simulate stile and rail construction, there is no clearance for water or moisture to reach any unfinished raw material. (2) Panels that are fixed and do not float also do not expose edges of unfinished raw material to the elements. (3). Raw materials in sheet form are also homogeneous and resist cracking, eliminating that mode of failure as well. (4). With CNC technology to carve the surface of the door face, raised panels of any imaginable design and size are able to be manufactured that would otherwise have been cost prohibitive from the tooling standpoint or impossible due to conventional raw material limitations.

Figure 8:
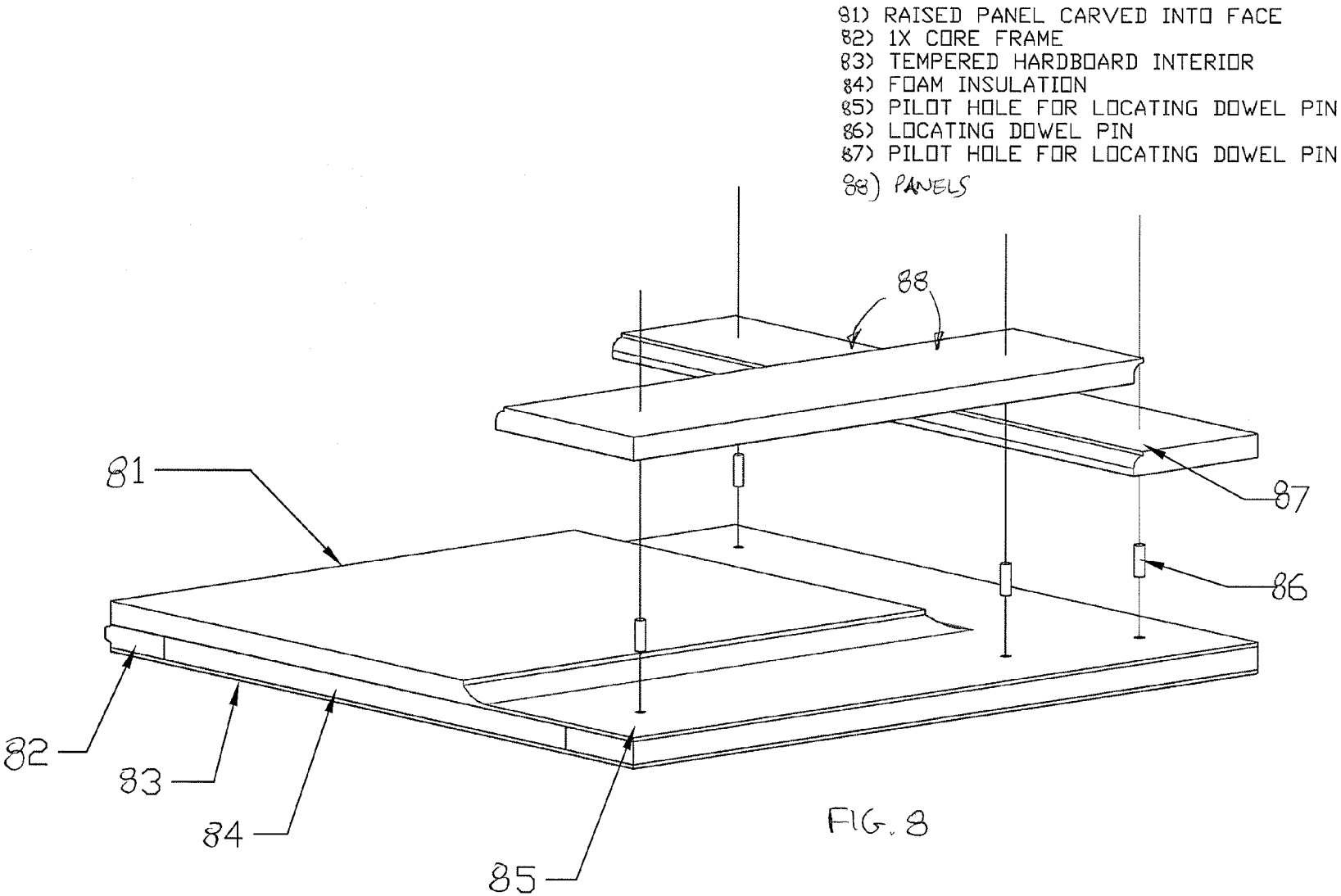
FIG. 8 depicts a partial view of a door in accordance with some embodiments of the present invention.

FIG. 8 depicts a perspective partial view of one example of a raised panel door having a raised panel carved into a face 81 (e.g., a stable sheet material as discussed above). As discussed above, the face 81 may be attached to a backing having, for example, a core frame 82, a hardboard interior material 83, and foam insulation 84. Overlays (panels 88) may be attached to the face 81 to frame the raised panel design carved therein. A plurality of locating pins 86 may be provided in respective holes formed in the face 81 and in the backside of the panels 88 (e.g., pilot holes 85 and 87). The locating pins 86 facilitate aligning and locating the panels 88 such that they may be placed about the raised panel with a high degree of alignment. The locating pins 86 further facilitate aligning and locating the panels 88 such that replacement pieces and/or sections of a multiple section door may be installed and/or interchanged while retaining a high degree of alignment.

Thus, embodiments of inventive doors and methods of fabrication have been provided that facilitate flexibility and ease of construction in a variety styles/designs. The door has a desired design carved into a solid flat face that may be efficiently manufactured using computer-aided machinery to fabricate the design. The use of computer-aided machinery facilitates raised levels of production as compared to traditional techniques while maintaining or improving quality, accuracy, and repeatability, as well as reducing changeover times and costs to implement new designs. Moreover, embodiments of the inventive door may further provide any one or more of the advantages discussed above, such as high degree of alignment of parts within a section and from section to section of multiple section doors, reduced failure due to exposure to adverse environmental conditions (e.g., water and UV exposure), flexibility of design, and other advantages over conventional doors as discussed above.

While the foregoing is directed to the illustrative embodiment of the present invention, other and further embodiments of the invention may be devised without departing from the basic scope thereof.

What is claimed is:

1. A carved, solid face door, comprising:

a solid base having a face and an opposing rear surface, wherein the face has a design carved into at least one section of the face;

one or more channels carved into the face adjacent to the design, each channel having a depth that is below a depth of the design carved into the face of the door adjacent to the channel, wherein the one or more channels comprise a plurality of channels and, wherein two channels of the plurality are formed in adjacent edges of the base and are positioned perpendicularly to one another and intersect at respective ends of each other;

one or more inlay panels disposed in and substantially covering a width of each of the one or more channels; and a backing coupled to the rear surface of the face.

2. The door of claim 1, wherein the design further comprises:

a bead board pattern or a v-groove pattern.

3. The door of claim 1, further comprising:

a plurality of locating pins disposed in respective pilot holes formed in the face and in the inlay panels to align the inlay panels with respect to the face.

4. The door of claim 1, wherein the solid base comprises a stable sheet material.

5. The door of claim 4, wherein the stable sheet material comprises at least one of wood, medium density fiberboard, plastic, or cellular polyvinyl chloride.

6. The door of claim 1, wherein the backing comprises:

an outer frame.

7. The door of claim 6, wherein the outer frame comprises at least one of wood, plastic, or metal.

8. The door of claim 6, wherein the backing further comprises:

an inner core disposed within the outer frame.

9. The door of claim 1, wherein the backing further comprises:

a skin covering at least one side of the backing.

10. The door of claim 9, wherein the skin comprises at least one of plywood, wood, plastic, medium density fiberboard, or hardboard.

11. The door of claim 1, wherein the face comprises a plurality of separable horizontal sections.

12. The door of claim 11, wherein the design flows between the plurality of separable horizontal sections.

13. The door of claim 1, wherein the one or more inlay panels have a thickness that is greater than the depth of the channel.

14. The door of claim 1, further comprising:

a backing coupled to the rear surface of the face and providing an exposed rear surface of the door opposite the face, wherein the design is carved only on the face and not on the exposed rear surface.

15. A carved, solid face door, comprising: a solid base having a face and an opposing rear surface, wherein the face has a design carved into at least one section of the face;

One or more channels carved into the face adjacent to the design, each channel having a depth that is below a depth of the design carved into the face of the door adjacent to the channel, wherein the one or more channels comprise a plurality of channels and, wherein two channels of the plurality are formed in adjacent edges of the base and are positioned perpendicularly to one another and intersect at respective ends of each other;

one or more inlay panels disposed in and substantially covering a width of each of the one or more channels, wherein the one or more inlay panels have a thickness that is greater than the depth of the channel; and A plurality of locating pins disposed in respective pilot holes formed in the face and in the inlay panels to align the inlay panels with respect to the face.

16. The door of claim 15, further comprising:

a backing coupled to the rear surface of the face and providing an exposed rear surface of the door opposite the face, wherein the design is carved only on the face and not on the exposed rear surface.

* * * * *